US005139054A

United States Patent [19]

Long et al.

[11] Patent Number: 5,139,054

[45] Date of Patent: Aug. 18, 1992

[54] SPRING INTERIOR FORMING AND ASSEMBLING APPARATUS

[75] Inventors: Thomas P. Long, Carthage; Michael L. Shelton, Joplin; Thomas J. Wells, Carthage, all of Mo.

[73] Assignee: Leggett & Platt, Incorporated, Carthage, Mo.

[21] Appl. No.: 724,408

[22] Filed: Jun. 28, 1991

[51] Int. Cl.[5] ..... B21F 27/16

[52] U.S. Cl. ..... 140/3 CA

[58] Field of Search ..... 140/3 CA

[56] References Cited

U.S. PATENT DOCUMENTS 3,958,610 5/1976 Garceau ..... 140/3 CA 4,886,249 12/1989 Docker ..... 140/3 CA

FOREIGN PATENT DOCUMENTS 289338 12/1987 Japan ..... 140/3 CA

*Primary Examiner*—Lowell A. Larson

*Attorney, Agent, or Firm*—Wood, Herron & Evans

[57] ABSTRACT

An apparatus for forming and assembling spring interiors is provided in which, in the preferred embodiment, adjustable reforming dies adjacent a cutting station lengthen the supporting structure of a bridging portion of the coil band that interconnects coils near the end of the band to compensate for the change of length caused by the cutting of the endmost bridging portion separating spring assemblies. Adjustable dies are also provided to vary the length of the bridging portions when they are initially formed. The coils are interlaced at a lacing station from continuous lacing coil bands.

19 Claims, 12 Drawing Sheets

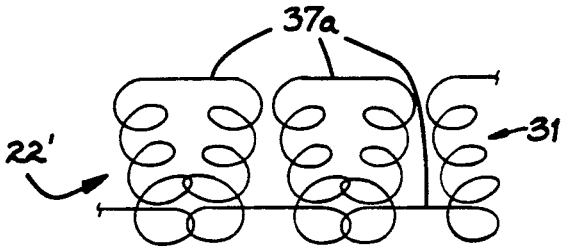
FIG. 9A
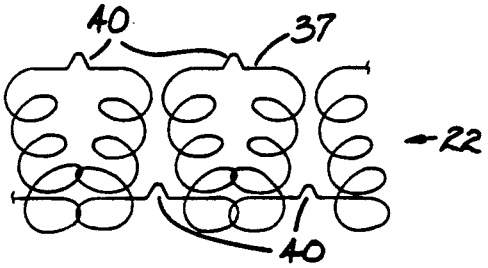
FIG. 9B
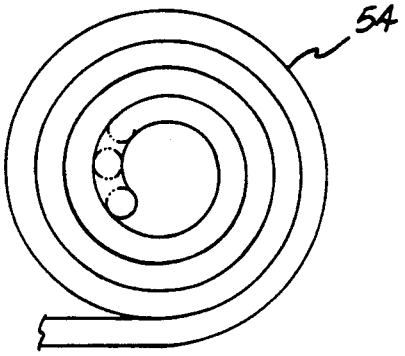
FIG. 9C
FIG. 9D
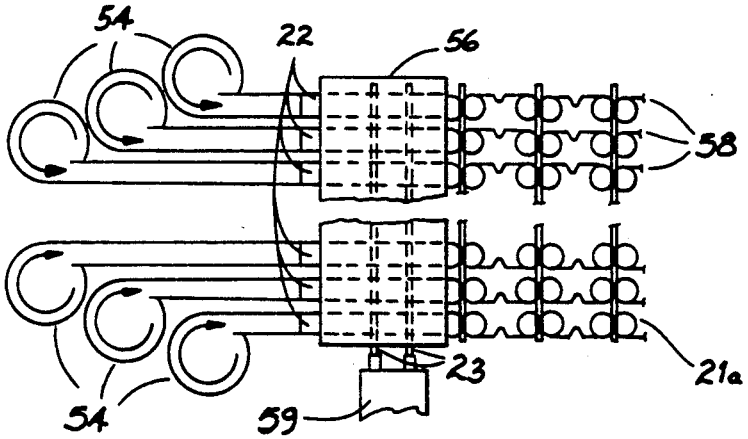

SPRING INTERIOR FORMING AND ASSEMBLING APPARATUS

This invention relates to apparatus for making spring interiors and, specifically, spring interiors for bedding products, such as mattresses and the like.

BACKGROUND OF THE INVENTION

A known form of spring interior comprises a plurality of longitudinally extending bands of springs disposed side by side and connected together by helical wires which extend transversely of the bands and embrace portions of the bands. Several kinds of bands of springs have been proposed for incorporation in spring interiors. One kind of band, which is the subject of British patent No. 1,104,884, will hereinafter be referred to as a band of interlocked springs. It comprises a single length of spring wire shaped to form a plurality of individual coil springs arranged in a row, one end turn of each coil spring lying adjacent to a top face of the band and the other end turn of each coil spring lying adjacent to a bottom face of the band, each coil spring being of a rotational hand opposite to the rotational hand of the adjacent coils immediately before and after it in the row, and being joined to the adjacent coil springs by a pair of interconnecting segments of wire integral with the coil springs. One of the pair of interconnecting segments is located in the bottom face of the band, and the other of the pair of interconnecting segments is located in the top face of the band. Each interconnecting segment comprises a bridging portion or section between adjacent coils, which bridging portion extends lengthwise of the row.

When bands of interlocked springs of the type described hereinabove, and more completely described in the above-identified British patent, are assembled together to form a spring interior, they are disposed side by side and interconnected by helical lacing wires, some of which lie in the top face of the spring interior and others of which lie in the bottom face thereof, the top and bottom faces of the spring interior being the faces defined by the top and bottom faces of the bands incorporated in the spring interior. Each helical wire extends across the bands of springs and embraces end portions of the interconnecting segments of the bands, which end portions extend transversely of the bands from the ends of the bridging portions. In the top face of the spring interior the helical wires are disposed at uniform intervals along the bands of springs, the arrangement being such that there are two springs disposed in the interval between each helical wire and the next. There is a similar arrangement in the bottom face of the spring interior.

The top face of a spring interior assembled in the manner described hereinabove has the general appearance of a rectangular grid. Each of the transverse elements of the grid comprises a helical wire, and each of the longitudinal elements of the grid comprises a row of mutually aligned bridging portions. Within the confines of each rectangle of the grid and disposed a little lower than the grid are the upper end portions of two adjacent coil springs, those two springs constituting parts of the same band of springs. The bottom face of the spring interior is, of course, similar to the top face, though inverted.

A characteristic of the spring interior described in British patent No. 2,143,731, as well as all spring interiors heretofore made from bands of interlocked springs, is that the bridging portions of the interconnecting segments between adjacent springs in one face, e.g. the bottom face, of the spring unit are offset by approximately one spring diameter from the interconnecting segments in the other face, e.g. the top face, of the spring unit. As a consequence of this offset relationship of the interconnecting segments, the endmost interconnecting segments in one face of the spring unit terminate in one-half of an interconnecting segment, while the endmost segment in the other face terminates in a full interconnecting segment. It is desirable that the length of wire contained in the half-length interconnecting segment be sufficient to form an attachment for fixing the endmost portion of the interconnecting segment to the perimeter or border wire which surrounds each face of the spring unit and still locate that border wire immediately above or below the other border wire attached to the full-length interconnecting segment. Because the formed half-length of the interconnecting segment in one face is generally not exactly one spring diameter in length, the border wire connected to that half-length of interconnecting segment is generally not parallel to or located immediately above or below the other border wire.

In order to overcome the natural zig-zag or offset configuration of the bridging portions of bands of interlocked springs which results from the interconnecting segments emerging on opposite sides of a common helical lacing wire one-half pitch apart, a spring interior has been proposed in U.S. Pat. No. 4,942,636, which employs interconnecting segments in which each band of springs has the interconnecting segments shaped with radii of different dimensions at the corners or intersections between the bridging portions and the end portions of interconnecting segments. U.S. Pat. No. 4,942,636 is expressly incorporated herein by reference. By providing substantially differing radii at the two corners of the interconnecting segment formed by the intersection of the bridging portion and the two end portions, the bridging portions of adjacent commonly laced interconnecting segments are axially aligned even though the end portions of those interconnecting segments project from the common lacing helical half a pitch apart along the length of the helical lacing wire. These differing radii "make up" the half-pitch difference in projection, and thus permit the bridging portions of the interconnecting segments to be colinearly aligned and located perpendicular to the axes of the helical lacing wires. Not only does this difference in radii enable the bridging portions of a band of springs to be colinearly aligned and located perpendicular to the helical lacing wires, but it also corrects the misalignment of the vertical axes of adjacent pairs of coil springs of a common band of springs which had heretofore characterized the prior art. The result is an assembled spring interior which is not subject to excessive stresses when the unit is deflected and which therefore is much more durable than prior art spring interiors formed from bands of interlocked springs. This modification also results in the longitudinal side edges of the spring interior being vertically aligned with one another on the top and bottom faces of the spring interior.

In order to overcome the problem of misaligned upper and lower border wires resulting from half-length interconnecting segments being connected to a border wire in one face of the spring unit and full-length interconnecting segments being connected to the border wire in the other face, the spring interior employs an interconnecting segment in one face which is severed at a point half way along its length and formed into a shape conducive to attachment to the border wire. In order that that border wire which is attached to the half-length interconnecting segment may be parallel to and located immediately above or below the border wire in the other face, an adjustment to the length of the interconnecting segment located immediately adjacent to the half-length interconnecting segment is made. This adjustment is made by flattening the supporting structure of the other bridging portions of the interconnecting segment in the face of the band of springs containing the half-length bridging segment. Alternatively, others of the bridging portions of interconnecting segments in the other face may be shortened by gathering in the supporting structure of bridging portions of interconnecting segments in that other face such that the overall length of the bands in both faces are identical and the border wires in one face overlie or underlie the border wire in the other face. In practice, any number of adjustments in the length of the interconnecting segments may be made by flattening or gathering in the supporting structure of one or more bridging portions of the bands so as to extend or reduce the face length of the bands of springs so as to locate one border immediately over the other and maintain the parallelism of the border wires.

The spring interior disclosed in U.S. Pat. No. 4,942,636 comprises a plurality of bands of springs, each band of which comprises a single length of wire shaped to form a plurality of individual coil springs arranged in a longitudinal row with one end turn of each coil spring lying adjacent to a top face of the band, and the other end turn lying adjacent to a bottom face of the band. Each coil spring is joined to the adjacent coil springs by interconnecting segments integral with the coil springs such that one of the interconnecting segments is located substantially in the top face of the band, and the other of the interconnecting segments is located substantially in the bottom face of the band. Each interconnecting segment comprises a bridging portion which extends longitudinally of the row and end portions which extend transversely of the rows. The bands are disposed side by side so that their top faces lie in a top main face of the spring interior and their bottom faces lie in a bottom main face of the spring interior. The bands are interconnected by helical lacing wires lying in the top and bottom faces of the bands and extending across the bands with each helical wire embracing adjacent end portions of the interconnecting segments of the bands. Each of the bridging portions of the interconnecting segments are connected at the ends to end portions of the interconnecting segments by radiused corners of substantially different radii so as to position adjacent bridging portions in substantially longitudinal alignment perpendicular to the helical lacing wires. The bridging portions of the edgemost bands of springs are connected to the border wire by wrapping laterally extending portions of the bridging portions about the border wire and by wrapping of the endmost end portions of the interconnecting segments of the bands of springs about the border wire. Additionally, the endmost bridging portions of the bands are severed at the midpoint of the endmost bridging portion of the band and being connected at the severed end to one of the border wires in one of the main faces of the spring interior, and others of the bridging portions of springs containing that midpoint severed bridging portion having the laterally extending portion of the bridging portion altered in configuration to change the length of those other bridging portions to thereby conform the overall length of the band in one main face of the spring interior to the length of the band in the other face.

Machines and methods for the manufacture of spring interiors and for the forming of springs and spring bands are disclosed in the following patents and patent publications hereby expressly incorporated herein by reference:

British Patent No. 1,095,980;

British Patent No. 1,104,884;

British Patent No. 1,183,315;

British Patent Application No. 8,712,969 filed Apr. 6, 1986, PCT/GB87/00381, International Publication No. WO 87/07541 published Dec. 17, 1987; and U.S. Pat. No. 4,886,249.

With the machines of the prior art, including those set forth in the patent documents incorporated above, spring interiors of the type discussed above are formed from a plurality of preformed spring bands, usually supplied in the forms of continuous spools, which are fed to an assemblying apparatus. With the prior art methods and apparatus, the spring bands have the bridging portions between consecutive spring coils formed in a forming operation prior to being supplied to the assemblying apparatus by which the bands are laced together and cut to form a spring interior. As such, the supporting structure of the bridging portions of the band, or "nose" as this supporting structure is sometimes called, is preformed to some predetermined dimension and shape which is predetermined by fixed dies in the spring band forming apparatus. The spring bands so formed are then supplied in coils to the spring interior assemblying apparatus. As a consequence, variations in the shape of the bridging portions are very difficult to accurately achieve. This is particularly of consequence when the size of the spring interior being manufactured and the dimensional tolerances of the bands and the assembly operation are not always precisely predicted when the spring bridging portions must be formed.

In addition, the assemblying machines of the prior art have typically performed the lacing function which transversely ties the plurality of bands together by feeding precut lacing springs from a supply magazine. This procedure requires the preforming of various lengths of lacing springs to accommodate the various widths of product being formed. Accordingly, the supplies must be changed and replenished, thus requiring a certain amount of labor and handling in the assembly operation.

With the assemblying apparatus of the prior art, spring interiors having the advantages of those disclosed in U.S. Pat. No. 4,942,636 present a certain difficulty and inefficiency in their manufacture. Accordingly, there is a need to provide an apparatus which is capable of precisely and efficiently manufacturing springs having the advantages of those disclosed in U.S. Pat. No. 4,942,636.

SUMMARY OF THE INVENTION

It is a primary objective of the present invention to provide an apparatus for manufacturing spring interiors more precisely and more efficiently, particularly those spring interiors having the properties and advantages of those disclosed in U.S. Pat. No. 4,942,636.

It is a more particular objective of the present invention to provide a spring interior assemblying apparatus which will efficiently manufacture spring interiors utilizing continuous coils of preformed spring bands which can be cut and shaped to the precise lengths required by the assembled spring interior product.

It is a further objective of the present invention to provide a spring assemblying apparatus by which the lengths of the spring bands can be precisely controlled and shortened or lengthened in the assemblying process as may be required.

It is a still further objective of the present invention to provide a spring interior assemblying apparatus having the ability to lace the bands of spring interiors together during assembly of any length from a continuous lacing spring supply.

According to the principles of the present invention there is provided a spring interior forming and assemblying apparatus with which the bridging portions or sections of the spring bands can be formed or reformed in the assemblying process to precisely control the length of the spring bands, and the transverse alignment of coils of adjacent bands, in the assembled spring interior product. More particularly, there is provided a spring interior forming and assembling apparatus through which a plurality of continuous spring bands are fed and by which each is cut and formed at the ends for assembly to a border band. The cutting and forming of the ends of the band are done by precisely cutting the bridging portions of the band and utilizing the spring material in an efficient manner.

According to the preferred embodiment of the present invention there is further provided a bridging section forming or reforming station coupled to, and spaced on a rigid frame from, the spring band cutting station to form or reform the nose or bridging portion of the band to a length appropriate for adjusting the overall length of the band to precise requirements, to transversely align the coils of adjacent bands, and particularly, to compensate for changes in the length of a bridging portion which is cut and formed at the band ends. More particularly, there is provided adjacent the cutting and forming stations which respectively cut and form the band ends, a band forming or reforming station which shapes or reshapes the bridging portion of the band adjacent to the cut end portion so as to compensate for the bridging portion length change, due to the cutting and forming operation of the ends, in a corresponding and offsetting manner.

Further in accordance with the principles of the present invention and in accordance with a preferred embodiment of the invention, there is provided a nose forming station in the band forming apparatus upstream of the cutting and reforming station. Both the nose forming station of the band forming apparatus and the nose reforming station adjacent the cutting station are adjustable so that the nose depth and, accordingly, its length, can be easily varied.

In accordance with the specific preferred embodiment of the present invention two bridging portion forming stations are provided, one in the band forming apparatus to initially form the nose, and one in the assembling apparatus to selectively reform the noses. The bridging portion adjacent the cutting station in the assembling apparatus is provided with special dies for lengthening the previously formed bridging portion of each band by flattening the preformed nose for the second to last of the bridging portions of each of the bands to thereby adjust the overall band lengths to make up for the shortening caused by the cutting of the ends of the bands. This nose reforming station and the bridging portion forming station provided at the band forming apparatus are provided with adjustable nose forming or reforming means such as adjustable dies, which will shape the bridging portions to an adjustable length, which length can be correlated with the requirements of the spring interior being assembled to provide a more precise overall length adjustment and better distribution and alignment of the springs of the spring interior.

Further in accordance with the principles of the present invention there is provided a continuous feed lacing station that cuts the lacing coils one at a time and feeds them as they are required in the assemblying process. The springs are cut to an adjustable dimension determined by the width of the spring interior product being assembled. With the lacing station of the present invention it is preferred that only the next required lacing spring be cut and held in the lacing apparatus prior to the feeding thereof so that no accumulation of precut lacing springs is required. The springs are accordingly cut and fed on demand by the lacing step of the assemblying apparatus.

In this description of the invention there are references to faces of bands of springs and of spring interiors. As the bands of springs and spring interiors are, of course, of openwork or skeletal form, the term "face" must be understood as referring to an imaginary surface defined by the relevant parts of the bands or spring interiors. Furthermore, as the wires and helical wires are of finite width or thickness and as they sometimes overlap each other, the term "face" cannot be understood as having a strictly geometrical meaning. Nevertheless, as the faces concerned are relatively extensive and are of flat shape, their locations can in practice be determined without difficulty or ambiguity.

These and other objects and advantages of this invention will be more readily apparent from the following description of the drawings in which:

BRIEF DESCRIPTION OF THE DRAWINGS

FIGS. 9A-9H are sequential diagrams of the progress of a spring band, during the formation and assemblying of a spring interior, through the operation of the apparatus of FIG. 8.

DETAILED DESCRIPTION OF THE DRAWINGS

Figure 1:
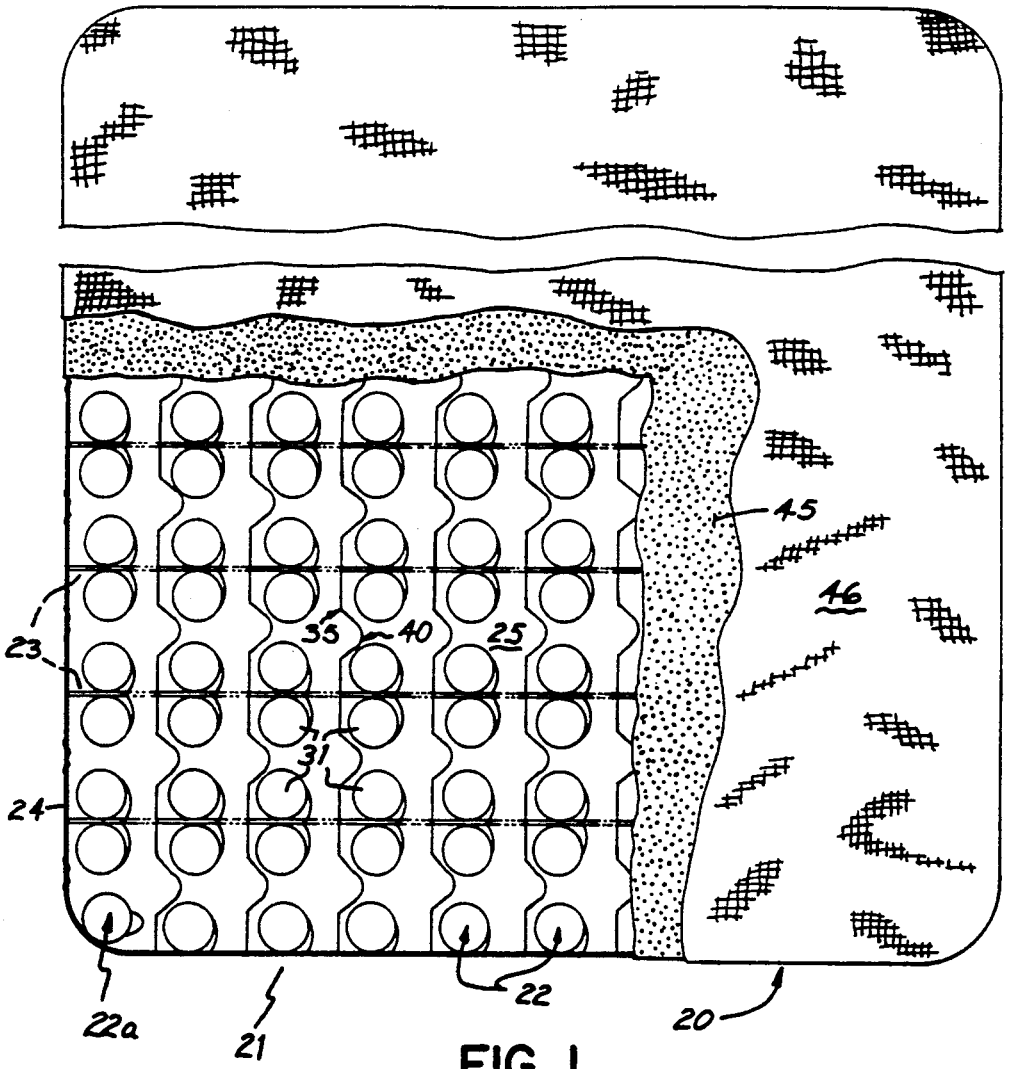
FIG. 1 is a top plan view, partially broken away, of a mattress incorporating the invention of this application.

An understanding of the spring interior forming apparatus of the invention will be better understood by first understanding the spring interior to be formed and assembled, which is illustrated in FIGS. 1-7.

With reference first to FIGS. 1-7, there is illustrated a mattress 20 embodying the invention of this application. This mattress 20 comprises a spring interior 21 formed from a plurality of bands of springs 22 which extend longitudinally of the mattress. These bands of springs 22 are laced together by helical lacing wires 23 which extend transversely of the spring interior and secure the bands of springs in an assembled relation. Border wires 24 extend completely around the periphery of the spring interior in the top and bottom faces 25, 26, respectively, of the spring interior 21 and are secured to the outermost edge of the spring interior in these planes by novel connecting means 27, 27' and 28.

Figure 4:
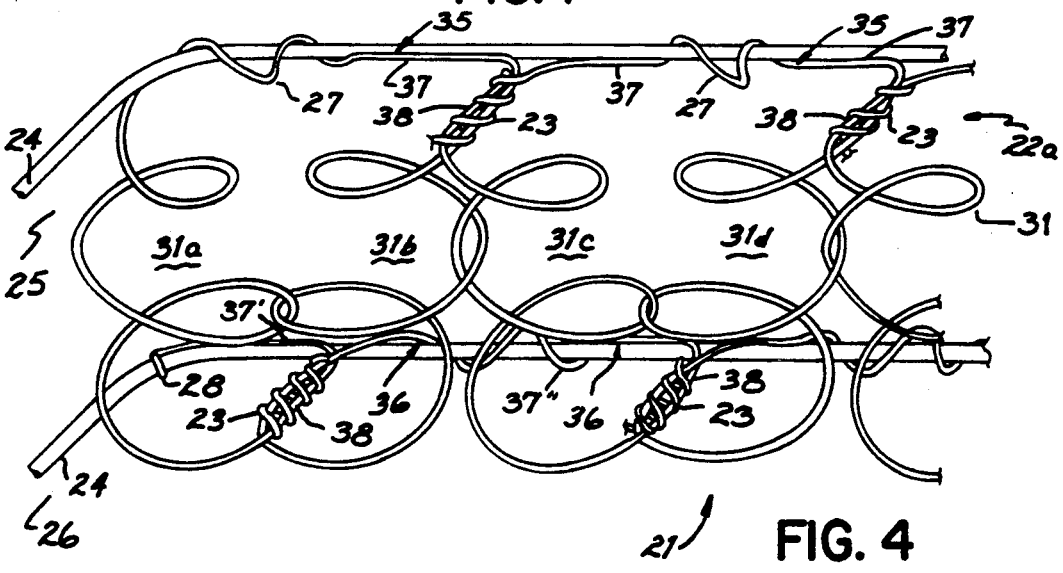
FIG. 4 is a perspective view of a portion of one band of springs of the spring interior of FIGS. 1-3.
Figure 6:
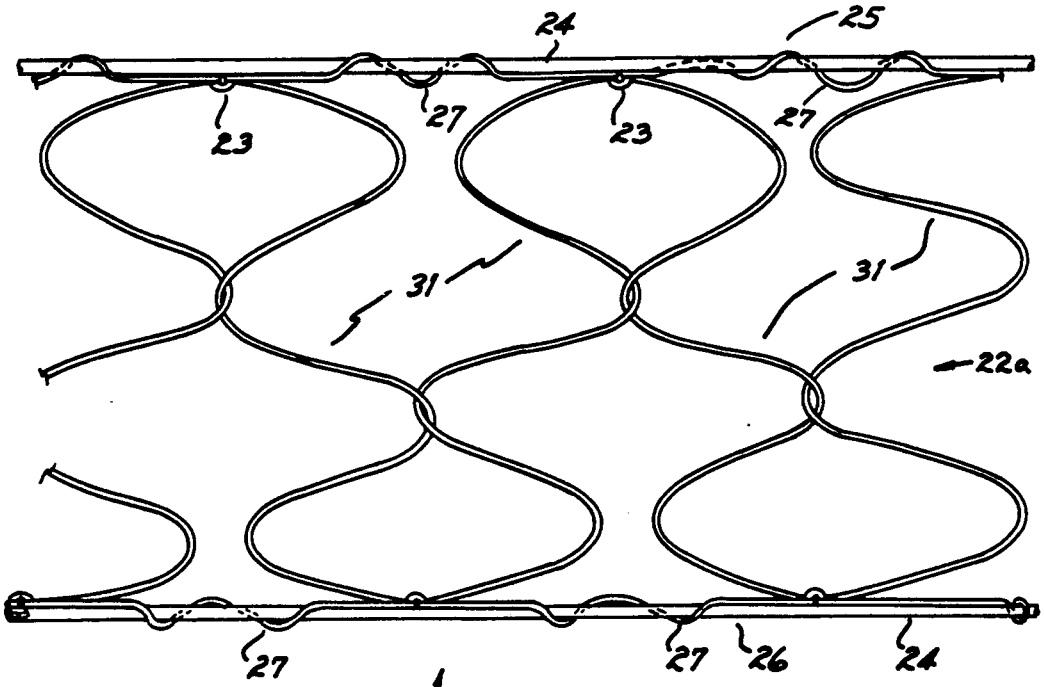
FIG. 6 is a side elevational view of the spring unit taken on line 6—6 of FIG. 2.
Figure 7:
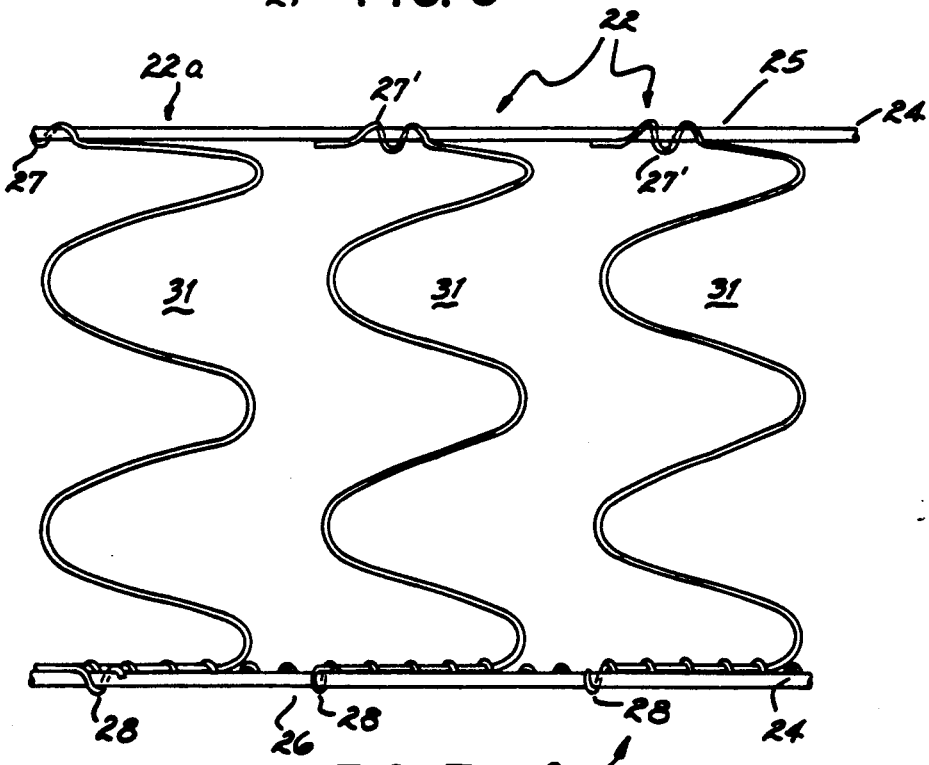
FIG. 7 is an end elevational view taken on line 7—7 of FIG. 5.

Each band of springs 22, a portion of one of which is illustrated in FIG. 4, is made from a single length of spring wire shaped to form a plurality of individual coil springs 31 arranged in a row. Each coil spring 31 comprises about two and one-half turns of wire. The axis of each coil spring is not upright but is inclined lengthwise of the band (as best illustrated in FIG. 6), each spring 31 being inclined in a direction opposite to that in which its two immediate neighbors in the row are inclined. The end turns of the coil springs 31 lie adjacent to the top and bottom faces 25, 26 of the band. Each coil spring, such as that numbered 31*b*, is so coiled as to have a hand opposite to the hand of the adjacent coil springs, such as 31*a* and 31*c*, immediately before and after it in the row. Each coil spring is joined to the next adjacent coil springs by two interconnecting segments 35, 36 of the wire integral with the coil springs. One of the two interconnecting segments 35, 36 is in the top face 25 of the band 22, and the other is in the bottom face 26 thereof. For example, coil spring 31*a* is connected to coil spring 31*b* by interconnecting segment 35, which is in the top face of the band, and the coil spring 31*b* is connected to coil spring 31*c* by interconnecting segment 36, which is in the bottom face of the band. Each interconnecting segment 35, 36 comprises a bridging portion 37, which extends longitudinally of the row of coil springs, and end portions 38, which extend in a direction normal to the longitudinal axis of the band 22. Those end portions 38 of the interconnecting segments 35, 36 also lie in the top and bottom faces 25, 26 of the band 22.

Figure 2:
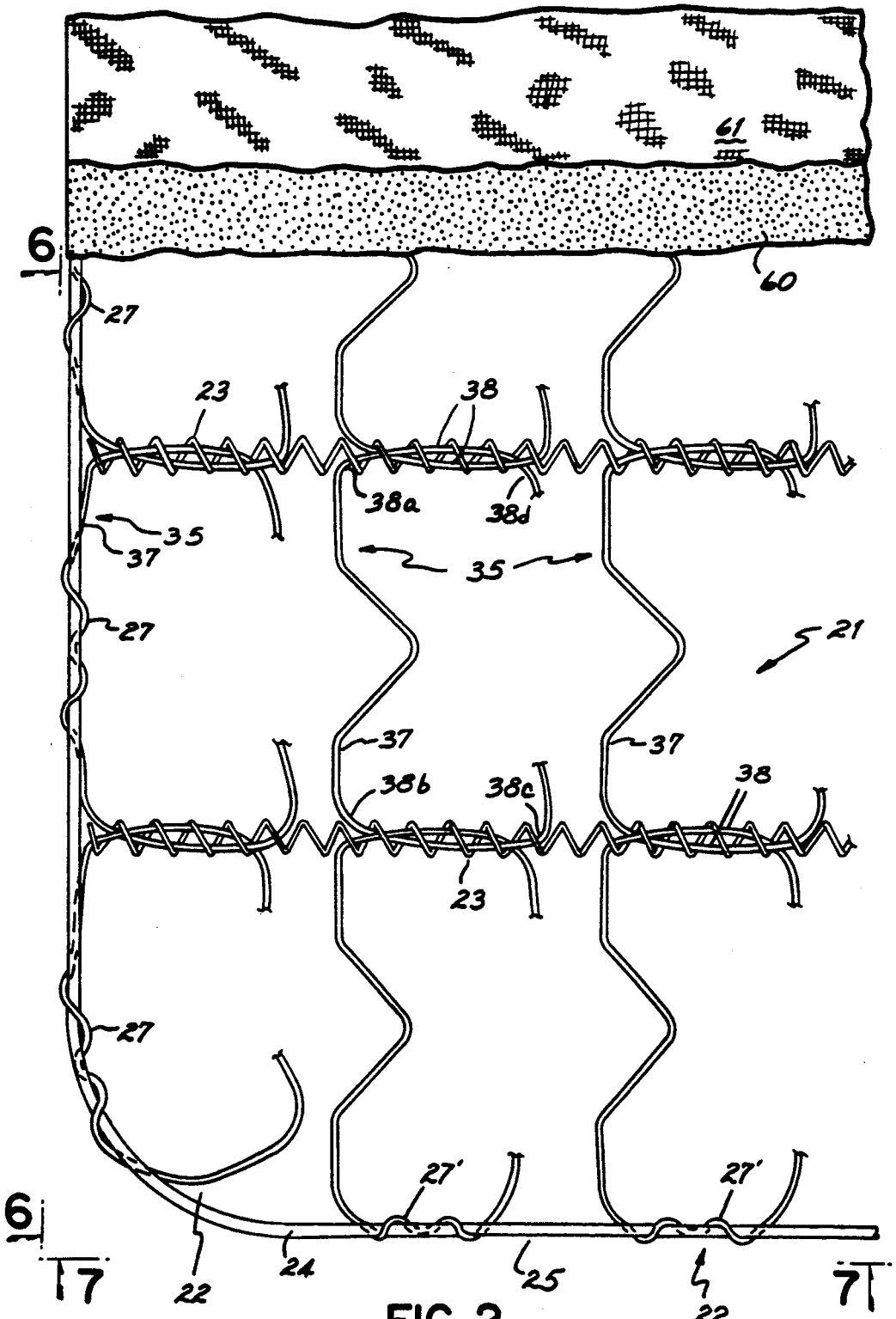
FIG. 2 is an enlarged top view of a corner portion of the mattress of FIG. 1.

The intersections of the end portions 38 of the interconnecting segments 35 are all radiused as may be most clearly seen in FIGS. 2 and 4. In the past, these radiused intersections or corners 38*a*, 38*b*, 38*c* and 38*d* (FIG. 2) of interlocked bands of springs have all been of the same radius. The invention of this application, though, departs from prior art practice in that each bridging portion 37 is connected to the end portion 38 at its opposite ends by radiused corners 38*a*, 38*b* of substantially different radii. The drawings illustrate these radii differences greatly exaggerated, but in one preferred embodiment of this invention, the radius 38*a* between one end portion and one end of the bridging portion 37 is one-quarter of an inch, while the intersection 38*b* between the other end of the bridging portion and the end portion 38 is five-eighths of an inch. Similarly, the intersections 38*c* and 38*d* between the end portions and the coil springs 31 to which they are connected differ in radius. The intersection 38*c* diametrically opposite from the intersection 38*a* is of the same radius as the intersection 38*a*, i.e., one-quarter inch in the preferred embodiment, and the other intersection 38*d* is of the same radius as the diametrically opposite intersection 38*b*, i.e., five-eighths inch in the preferred embodiment. These differing radii are very significant to one aspect of this invention because they enable the bridging portions of a single band of springs to be longitudinally aligned with one another when the spring interior is assembled and the bands are interlaced by the helical lacing wires 23. These differing radii also function to enable the bridging portions 37 to be aligned perpendicular or normal to the helical lacing wires 23, rather than being skewed relative thereto as has been the practice in the prior art. Additionally, these differing radii enable the vertical axes of all of the coils of springs of a band of springs to be vertically aligned with one another when viewed in the longitudinal direction of the band rather than being vertically skewed as has been characteristic of prior art spring interiors made from interlocked bands of springs. This improved alignment of the bands of springs which results from the differing radii of the interconnecting segments of the bands is explained more fully hereinafter in connection with the assembly of the spring interior 21.

Each bridging portion 37, in addition to extending longitudinally of the band, also extends laterally thereof to form a supporting structure 40. In the embodiment of FIGS. 1-7, the supporting structure 40 is shaped in the form of an inwardly extending V lying in the top 25 or bottom face 26 of the band 22, as the case may be, and extending to one side of the remainder of the bridging portion 37 of which it forms a part. Each V-shaped supporting structure 40 lies half way between the end portions 38 of the interconnecting segment of which it forms a part, and it extends approximately half way across to the other side face thereof. Each V-shaped supporting structure includes an arcuate central part 42 connected at its opposite ends to diverging arms 43, which are in turn connected to the end portions 38.

Figure 3:
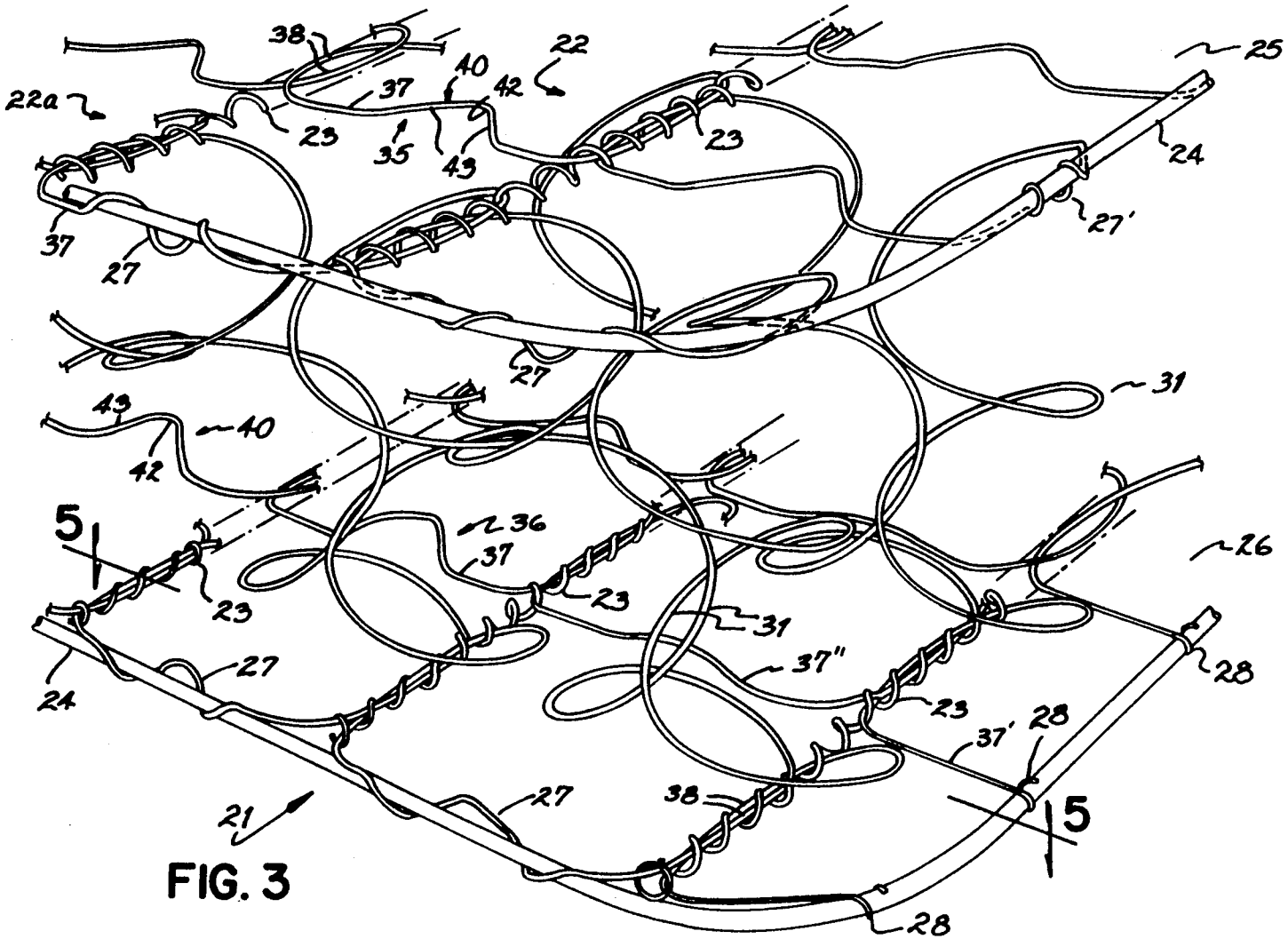
FIG. 3 is a perspective view of a corner portion of the mattress of FIG. 1.

Again, with particular reference to FIGS. 3 and 4, it will be seen that the supporting structure 40 of the edgemost bands of springs 22*a*, rather than extending inwardly toward the opposite side of the band, are wrapped as at 27 about the border wire 24 which extends parallel to and rests against the bridging portions 37 of the outermost band. The depth of the V shape of the supporting structure 40 is sufficient in the preferred embodiment of this invention to enable the V-shaped supporting structure 40 to make slightly more than one full wrap about the border wire, and thereby secure the border wires to the top and bottom faces of the spring interior by the connecting means 27 formed from the supporting structure 40.

With particular reference now to FIG. 2, it will be seen that the endmost end portions 38 of each band of springs in the top face is secured to the border wire by wrapping of that endmost end portion 38 about the border wire to form an end connecting means 27'. This connecting means 27' also forms approximately one full wrap about the border wire 24.

Figure 5:
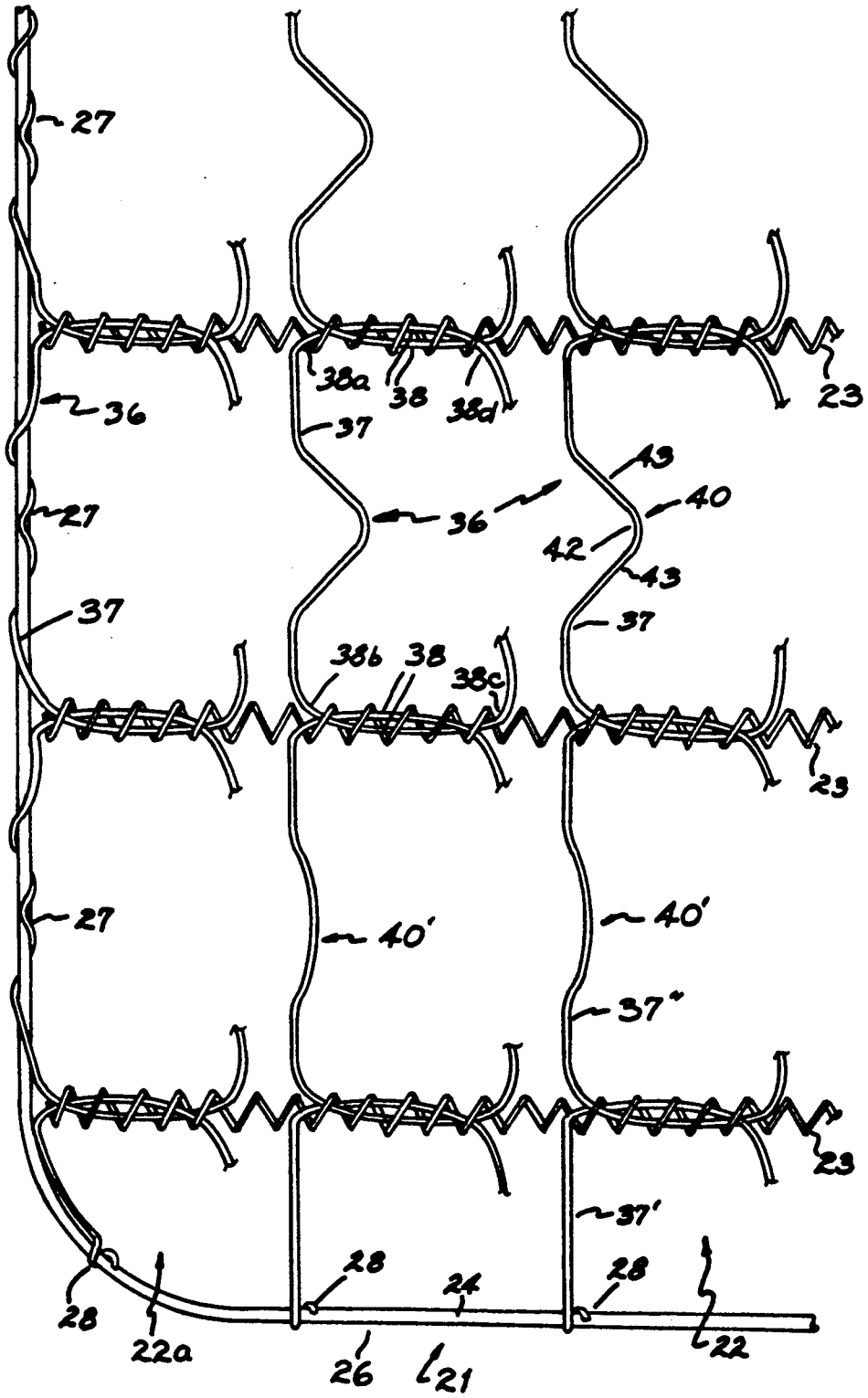
FIG. 5 is a cross-sectional view taken on line 5—5 of FIG. 3 illustrating the configuration of the bottom face of the spring unit of FIG. 1.

With reference now to FIGS. 4 and 5, it will be seen that the ends of each band cannot be connected to the bottom border wire in the bottom face of the spring interior in the same manner as the border wire is connected to the ends of the bands 22 in the top face because the endmost lower interconnecting segment 36 of each band of springs is offset by the diameter of one spring 31 from the endmost interconnecting segment 35 in the top face of the spring interior. Consequently, in order to have the border wire 24 of the top face located immediately above the border wire 24 in the bottom face, only one-half of a bridging portion 37 is present at the lower end of each end of each band 22 of springs. In order to connect that half length interconnecting segment to the border wire, the endmost bridging portion 37 in each band of springs is severed at the midpoint of the bridging portion and is straightened to form an endmost half-length bridging portion 37', the end of which is wrapped about the border wire 24. That end forms the connecting means 28 between the end of each band of springs and the border wire 24 in the bottom face 26 of the spring interior 21. That connecting means 28 may be welded or otherwise fixed to the border wire in order to prevent lateral movement of the band relative to the border wire.

Because the half-length 37' of the interconnecting segment 37 may be insufficient in length to position the bottom border wire immediately beneath the top border wire so as to form a square end on the spring interior 21, the invention of this application contemplates that the supporting structure 40' may be lengthened by flattening the band, as illustrated in the bridging portion 37'' in the transverse row of bridging portions located immediately adjacent to the half-length bridging portion 37'. Alternatively, the length of the bands of springs 21 may be shortened by gathering or moving the diverging legs 43 of the V-shaped supporting structure toward one another. In the practice of this invention, though, lengthening of the band is generally required in order to position the bottom border wire immediately beneath and in the same vertical plane as the top border wire. This is accomplished by flattening the V-shaped supporting structure 40' in the transverse row 37'' of bridging portions located immediately adjacent to the endmost half-length bridging portions 37'.

The method of manufacturing and the apparatus for manufacturing the band of springs illustrated in FIG. 4 is completely described and illustrated in British patent No. 2,143,731. After the rows of coil springs are formed, each coil spring is coupled with the next by having an intermediate turn thereof passed around an intermediate turn of the next spring. This coupling can be carried out mechanically or manually. The coil springs 31*a*, 31*b* and 31*c*, illustrated in FIGS. 4 and 6 are coupled in this manner.

A plurality of bands of springs 22 are assembled to form a spring interior 21. Bands of springs 22, each similar to that shown in FIGS. 1–4, are disposed side by side, and preformed helical wires 23 are attached to them. The helical wires 23 lie in the top and bottom faces 25, 26 of the bands and extend at right angles to the longitudinal axes of the bands. Each helical wire 23 embraces one pair of closely adjacent end portions 38 of each band.

It will be seen from FIGS. 2, 3 and 5 that much of the top and bottom faces of the spring interior has the general appearance of a rectangular grid. Each of the transverse elements of the grid comprises a helical wire 23 with the end portions 38 embraced by it, and each of the longitudinal elements of the grid comprises a row of mutually aligned bridging portions 37. Within the confines of each rectangle of the grid and disposed a little lower than the grid are the upper end portions 38 of two adjacent coil springs 31. Were it not for the presence of the supporting structure 40, the top face 25 and bottom face 26 of the spring interior 21 would present relatively large rectangular apertures into which upholstery material, such as filling or padding 45 (FIG. 1), placed on top of the top face could readily enter, thereby giving rise to "cupping." The presence of the supporting structure 40, however, reduces any tendency to "cupping," as the supporting structures occupy central parts of the rectangular apertures and can serve to support the upholstery material. And this same supporting structure 40 functions in the case of the two edgemost bands to tie the border wire 24 to the spring interior 21 on the side of the spring interior 21 when the supporting structure 40 of the edgemost bands is wrapped about the border wire.

The spring interiors described hereinabove can be incorporated in an article, such as an upholstered mattress or seat. Irrespective of the item of furniture in which the spring interior 21 is placed, one or more layers of padding or filling 45 are generally placed across the top end or bottom face of the spring interior and covered with a suitable cover material 46.

In addition to being more durable than prior art spring interiors made from bands of interlocking springs, the unique spring interior 21 of this invention has been found to be more stable under load and to better conform to the contours of a body resting atop the interior 21.

The invention of this application also results in a more perfectly squared spring interior as a consequence of the adjustability of the length of a band of springs. That adjustable length derives from extension of the length of the band by flattening the supporting structure 40 to extend the length of the bridging portion 37, or by gathering in that supporting structure to shorten the length of the bridging portion. Thereby, the border wires in the top and bottom faces of the spring interior 21 may be located immediately above and below one another so as to present squared corners on the resulting spring interior. In this way, the endmost bridging portion of a band of springs may be severed at its mid-length point and connected to the border wire, while a full-length bridging portion is connected to a border wire in the opposite face. And, any difference in length of the bands in the two faces may be accommodated by lengthening the bridging portion 37'' of the spring band located adjacent to the half-length bridging portion or, if necessary, by gathering it in to shorten it. Such lengthening or foreshortening of the supporting portion 40 may be accomplished in a single row of interconnecting segments 37, or may be located in multiple different rows of the spring interior. Additionally, such extending or foreshortening of the bridging portions of selected rows of the bands of springs may be located in one face or in both faces of the spring interior.

As a consequence of utilizing the wire of the supporting portion of the interconnecting segments of the bands of springs to connect the edgemost bands to the border wire or the endmost end portions of the interconnecting segments to the border wire, substantial savings may be made in the cost of materials to form a complete spring interior because there is no longer any need for metal clips or lacing wires to make the connection. Additionally, the wrapped, as opposed to sheet-metal clipped, connection of the bands of springs to the border wire has been found in many instances to be less noisy than sheet-metal clipped or helically laced wire connections.

Formation and assembly of the above-described spring interiors 21 may be achieved with the spring interior manufacturing system or multiple component apparatus 48 which includes one or more spring band forming apparatuses 49 and the spring interior forming and assemblying apparatus 50. The apparatus 48 is illustrated diagrammatically in the perspective drawing of FIG. 8.

The coil forming apparatus 49 includes a coil forming station 51 and a support structure forming station 52. The coil forming station has an upstream end which receives a continuous strand of wire 53 which it forms into alternate left and righthand coils 31 each of which is separated by a straight piece of wire or bridging portion 37 of the top and bottom connecting segments 35 and 36. The coil forming station 51 may include coil and spring forming devices such as those disclosed in U.S. Pat. application Ser. No. 07/560,371, filed Jul. 30, 1990, entitled Continuous Coil Spring Forming Method and Apparatus and U.S. Pat. application Ser. No. 07/551,139, filed Jul. 11, 1990, entitled Programmable Servo-Motor Quality Controlled Continuous Spring Coil Forming Machine, both hereby expressly incorporated herein by reference.

From the coil forming station 51 the spring coil band is sent to the support structure forming station 52 which forms the supporting structure or nose 40 into the bridging portion 37. The coil forming apparatus 49 produces a continuous spring band. A plurality of the forming apparatuses 49 may be connected to a spring forming and assembling apparatus 50, each to supply one continuous band directly thereto to be assembled into a spring interior. Alternatively, the spring forming apparatus 49 may form the spring into a coil or continuous spooled band 54, a plurality of which would then be transported to and fed to the spring forming and assembling apparatus 50, each feeding one band thereto, one for each row of the springs of spring interior.

The spring forming and assembling apparatus 50 includes an assembler or lacing station 56 which has an upstream end 57 into which a plurality of bands from a corresponding plurality of spools 54 is fed, each parallel to each other along a plurality of paths 58 through the assembling apparatus 50. At the lacing station 56, a helical wire feeding device 59, positioned at the side of the lacing station 56 feeds the lacing wires 23 transversely across the paths 58 to lace together the top and bottom faces of the spring interior 21. The lacing coils 23 are fed from the continuous spool of coil and lace the springs by rotating as they advance. Each length of lacing wire 23 is cut to length as it is fed from the device 59. Accordingly, emerging from the downstream end of the lacing station 56 is a continuous spring interior one of a plurality of longitudinally extending bands joined by transversely extending lacing coils 23.

The spring forming and assembling apparatus 50 also includes a support structure reforming station 60 positioned downstream of the lacing station 56 and a cut-off station 61 positioned downstream of the support structure reforming station 60. From the lacing station 56, the continuous interlaced bands advance through the reforming station 60 and cut-off station 61. At the reforming station 60, selected ones of the supporting structures or noses 40, and preferably the one of each band which is to be adjacent to, in the plane of, the endmost bridging portion 37, is flattened or lengthened. At the cut-off station 61, the end bridging portion which is cut or severed into two portions so that a spring interior **21*b* is separated from the continuous spring interior 21*a* and advanced downstream to a station for the application of the border wires 24. The lacing station 56, the reforming station 60 and the cut-off station 61 are joined together by, and supported on, a common rigid frame 62**.

An understanding of the structure of the spring interior manufacturing or forming system or apparatus 48, including the forming apparatus 49 and the forming and assembling apparatus 50, will be best understood by a person understanding the forming, cutting and assembling operations of the system 48.

Figure 8:
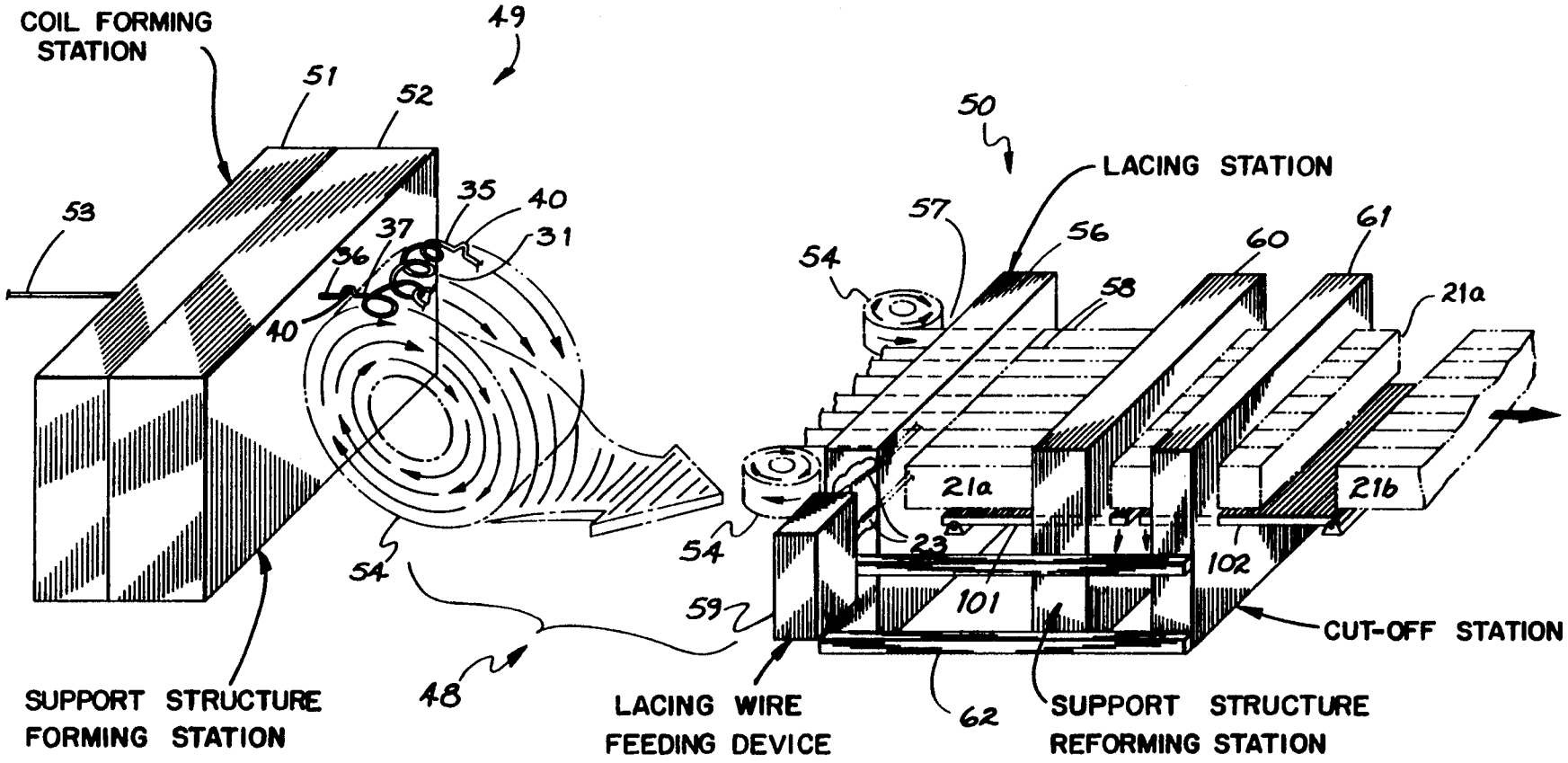
FIG. 8 is a diagrammatic perspective view of one preferred embodiment of a spring interior forming and assemblying apparatus suitable for the manufacturing of spring interiors of the type illustrated in FIGS. 1-7 above.

As shown in FIG. 9A, the coil forming station 51 of FIG. 8 forms the continuous strand of wire 53 into the continuous partially formed spring band 22' having a plurality of coils 31 of alternating rotation each interconnected by a straight length of wire **37*a*. These coils interlock in the manner described above. The partially formed band 22' then passes through the support structure forming station 52 at which the support structures 40 are formed in the straight lengths of wire 37 to produce the support structure 40 as described above, as illustrated in FIG. 9B, to form the continuous bands 22. The continuous spring bands are then preferably formed into coils 54 as illustrated in FIGS. 8 and 9C**. Alternatively, the continuous bands may be fed directly into the spring forming and assembling apparatus. Each of these alternatives has its own advantages.

For feeding the bands 22 directly into the forming and assembling apparatus 50, one coil forming apparatus 49 is required for each of the plurality of bands of which the spring interior is to be made. As such, one band 22 would be fed along each of the paths 58 of the assembling apparatus 50. The advantages of such an embodiment include the elimination of the coil handling operation and the need to stop the assembling process while additional coils of bands 22 are being resupplied to the assembling apparatus 50. A further advantage is in the ability to correct the forming of the noses at the support structure forming station 52 as required by observations of the product being formed at the assembling apparatus 50. In this way, should the noses formed be too deep or to shallow, a minimum amount of length of the bands 22 will be wasted in that readjustment of the nose depth at the nose forming station 52, as described in accordance with one feature of the invention described below, can be performed with in-line adjustments of the apparatus.

In the preferred alternative embodiment, the springs are coiled. While this method results in a risk of greater waste of lengths of coil bands should the nose depths be improperly adjusted initially, fewer of the forming apparatuses 49 are required. This is generally preferred with equipment presently available because the forming apparatus 49 produces the bands 22 at a different rate than they are advanced through the assembling apparatus 50 when it is operating at its optimum capacity. Usually, however, more than one forming apparatus 49 is required to supply all of the spools 54 of bands 22 required by the assembling apparatus 50.

Referring to FIGS. 8 and 9D, the spools 54 of bands 22 are fed through the lacing station 56 and there the lacing coils 23 feed transversely to the paths 58 from the lacing wire feeding device 59. Accordingly, from the downstream end of the lacing station 56 emerges the continuous interlaced spring interior band 21*a*. This continuous spring interior is then fed through the support structure reforming station 60 and then through the cut-off station 61. The stations 60 and 61 are spaced along the spring interior band 21*a* such that the cutting station is located downstream from the reforming station 60 to bridging portion 37 lengths, whereby, when one bridging portion 37 of the bottom base of the spring interior is located at the reforming station, an adjacent bridging portion 37 in the bottom face is located between the reforming 60 and cut-off 61 stations and then the next downstream adjacent bridging portion is located at the cut-off station 61.

Figure 9E:
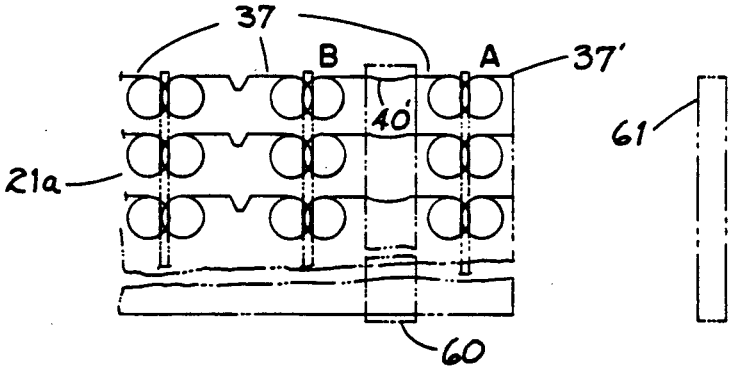

Referring now to FIG. 9E, there is illustrated the continuous spring interior 21*a* positioned with the bridging portion section 37 that will be the leading edge of the spring interior 21 positioned between the reforming station 60 and the cut-off station 61. This is the bridging 37'. Such a bridging portion will be hereinafter referred to as bridging portion A in FIGS. 9E–9H, which lies in a transverse row of corresponding bridging portions of each of the parallel bands. In FIG. 9E, when the bridging portion A is located between the reforming station 60 and the cut-off station 61 the next adjacent bridging portion of the bottom plane, bridging portion B is located at the reforming station 60 where, through the operation of the reforming station 60 it is flattened to form a support structure 40, as illustrated in FIG. 9E.

After the bridging portion B is flattened to form the supporting structure 40' as shown in FIG. 9E, a plurality of bridging portions 37 of each row are advanced, as the bands are indexed through the reforming station 60, until what is intended to be the trailing edge of a spring interior, another end bridging portion A, is advanced to immediately adjacent on the upstream side of the reforming station 60. At this point, the last three adjacent bridging portions, designated portions X, Y and Z in FIG. 9F, will have advanced sequentially through or to the reforming station 60.

Figure 9F:
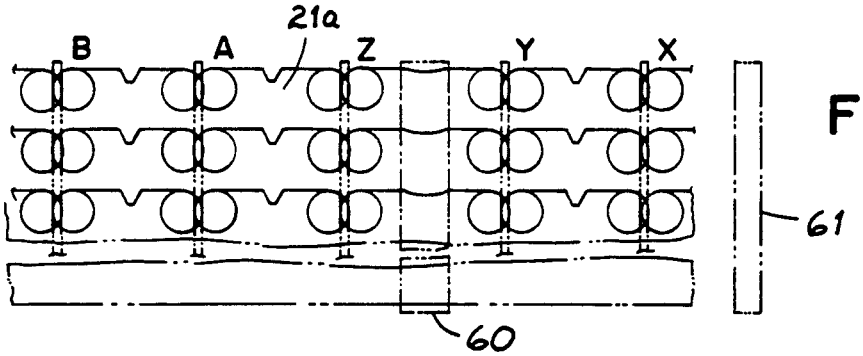
Figure 9G:
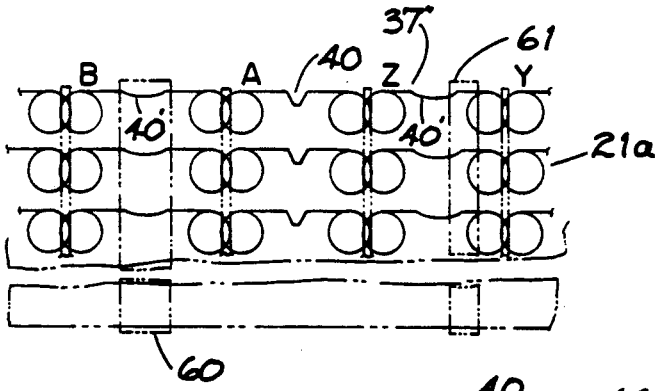

When the last bridging portion, portion Z, which is immediately adjacent a subsequent end section A, is positioned at the reforming station 60, its support structure 40 is flattened to form the support structure 40' as illustrated in FIG. 9F. Then, once this bridging portion is formed, the continuous spring interior 21*a* is indexed to advance bridging portion A through the reforming station 60 and to bring another bridging portion B to the reforming station 60 as was the case in FIG. 9E as shown in FIG. 9G. Thereupon, the supporting structure 40' is reformed in the section B by flattening the support structure of the bridging portion B at the reforming station 60. At this point, two flattened bridging portions 40', as shown in FIG. 9G are formed of bridging portions B and Z of the band, with support structure 40 formed in bridging portion A lying therebetween. Then, the continuous spring interior 21*a* is advanced or indexed one position downstream, to the position of FIG. 9H, to bring the section A to the cut-off dies of the cut-off section 61, with sections B and Z lying on opposite sides thereof, such that the flattened support structure 40' constitutes the bridging portions B and Z that will be next to the cut end bridging portion A of the spring interior 21. At this point, the bridging portion 40 at the cut-off section 61 is cut, severing a spring interior portion 21*b* which is then ready to be formed into a spring interior 21 with the addition of border bands thereto. FIG. 9E represents a start-up position. From the start-up position the coils advance through the position shown in FIGS. 9F, 9G and 9H. In continuous operation, from position 9H the partially formed spring interior advances to the position of FIG. 9F then of 9G then of 9H then again to that of FIG. 9F, etc.

The apparatus of FIG. 8 which implements the operation illustrated in FIGS. 9A–9H includes the coil forming apparatus 49 which has the coil forming station 51. The coil forming station 51 may for example comprise the machinery described in British Pat. No. 1,327,795 entitled "Improvements In or Relating to Machines for the Manufacture of Compression Spring Strips from Wire, For Example for Upholstery Inserts," or may include that described in U.S. Pat. application Ser. No. 07/551,139, filed Jul. 11 1990 entitled "Programmable Servo Motor Quality Controlled Continuous Spring Forming Machine," or may include that described in U.S. Pat. application Ser. No. 07/560,371, filed Jul. 30, 1990 entitled "Continuous Coil Spring Forming Method & Apparatus," all expressly incorporated by reference above.

Figure 12:
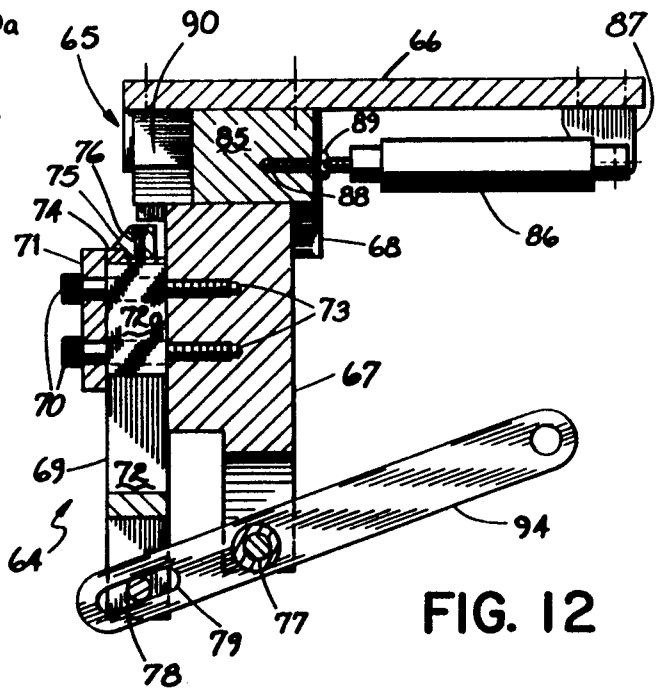
FIG. 12 is a cross-sectional taken on line 12—12 of FIG. 11.
Figure 11:
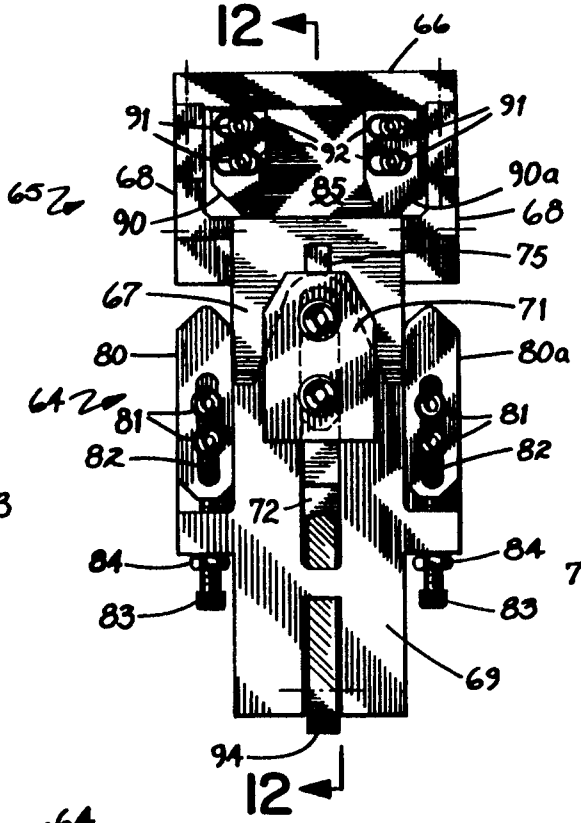
FIG. 11 is an end elevational view of the forming dies, looking in the direction of line 11—11 of FIG. 10.
Figure 10:
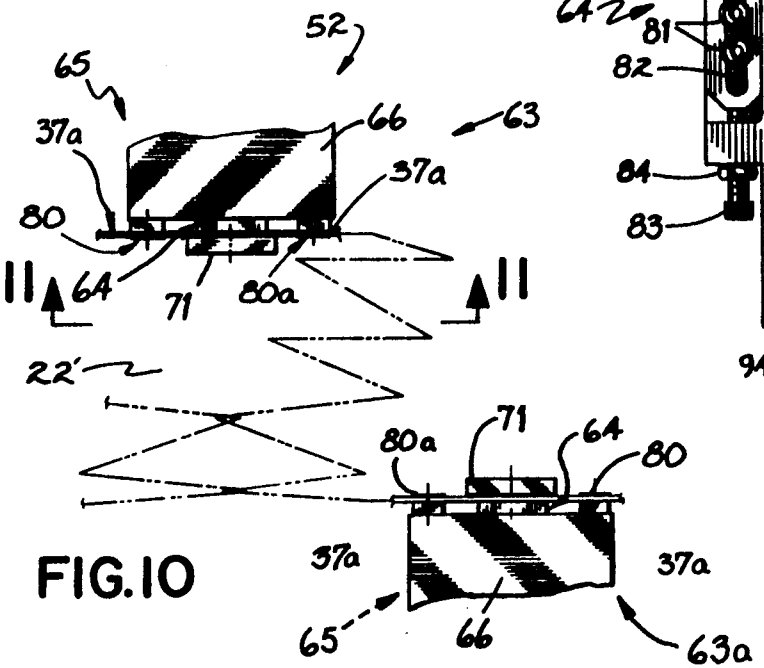
FIG. 10 is a plan view in greater detail of a pair of the forming dies of the nose forming station of the coil forming apparatus of the system of FIG. 8.

The coil forming apparatus 49 furthermore includes the support structure forming station 52 which embodies certain principles illustrated in FIGS. 10–12. The nose or bridging member forming station 52 includes a pair of forming die assemblies 63 and 63*a* positioned on opposite sides of the partially formed coil band 22*a*, so that they can close upon a bridging portion 37*a* the band 22' is indexed to a position shown in FIG. 10. In this position, the partially formed bridging portions 37*a* lie over movable die subassembly 64, shown as part of the die assembly 63 in FIG. 10. The assemblies 63, 63*a* each include an upper or stationary die assembly 65, which is movable from beneath the assembly top plate 66 horizontally to a position overlying the bridging portion 37*a*. In practice, the two dies are retracted and extended simultaneously so that those of the die assembly 63 and 63*a* can each form a bridging portion simultaneously without intervening movement of the band 22*a* in the process.

Referring to FIGS. 10–12 simultaneously, the die assemblies 63, 63*a* include a stationary center block 67 rigidly mounted with respect to the top plate 66 through a pair of side blocks 68. To the center block 67, the lower movable die 64 is mounted to slide vertically thereon. The lower die assembly 64 includes a movable nose former 69 having a slot 72, the nose former 69 being slidably mounted to the center block 67 with bolts 70. These bolts extend through a plate 71, a slide gib 72*a* in slot 72 and into threaded bolt holes 73 in the block 67. The former 69 has an upwardly protruding nose forming surface 74 formed in the top thereof. At the upwardly extending tip of the surface 74 of the former 69 is a former insert 75 rigidly secured thereto by bolts 76. The former 69 is raised and lowered on the block 67 by the action of a former lever 94 which is pivotally mounted to the block 67 at a dowel pin 77 mounted thereon. Former 69 is drivably linked to the lever 94 through a dowel pin 78 in the former 69 which extends through a slot 79 in the lever 94. The lever 94 is, at its end opposite that carrying the slot 79, drivably linked to a pneumatic piston, cam driven mechanical drive or other actuator mechanism (not shown). A pair of platform blocks 80, 80*a* are adjustably fixed to the former 69 by a pair of bolts 81 which extend through a slot 82 in the platform blocks 80, 80*a* and threaded into the former 69. The bolts 81 tighten and loosen the platform blocks to allow adjustment with an adjustment screw 83 in the former 69 which is locked in place with a lock nut 84.

The upper or fixed die assembly 65 includes a slide block 85 mounted to slide horizontally into and out of the path of the band 22' through a channel formed by the plate 66, the block 67 and side blocks 68. The block 85 is reciprocated with a pneumatic cylinder 86 which is drivably connected between the plate 66 to which it is pivotally connected by way of a bracket 87 and the piston rod end 88 which is secured to the slide block 85 with a jam nut 89. The slide block 85 has adjustably mounted thereto a pair of stationary formers 90 and 90*a*. The formers 90 and 90*a* are secured to the block 85 each with a pair of bolts 91 which extend through horizontal slots 92 in the formers 90. The bolts 91 tighten and loosen the stationary formers 90 from the block 85 to provide adjustment. The adjustments of the stationary formers 90, 90*a* and the platform blocks 80, 80*a* determine the depth of the noses 40 formed in the bridging portions 37 as well as the overall length of the bridging portions 37 and thereby the spacing of the coils 31 joined by the respective bridging portions 37. The die assemblies 63, 63*a* form all of the bends of the bridging portions 37 between the coils 31 including the differing radius bends 38*a* and 38*b* (FIG. 2).

Figure 9H:
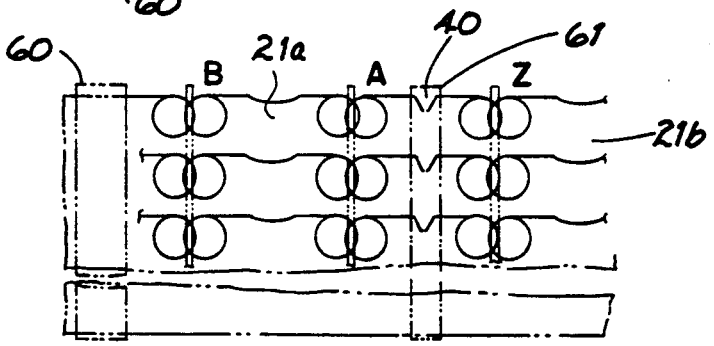
Figure 13:
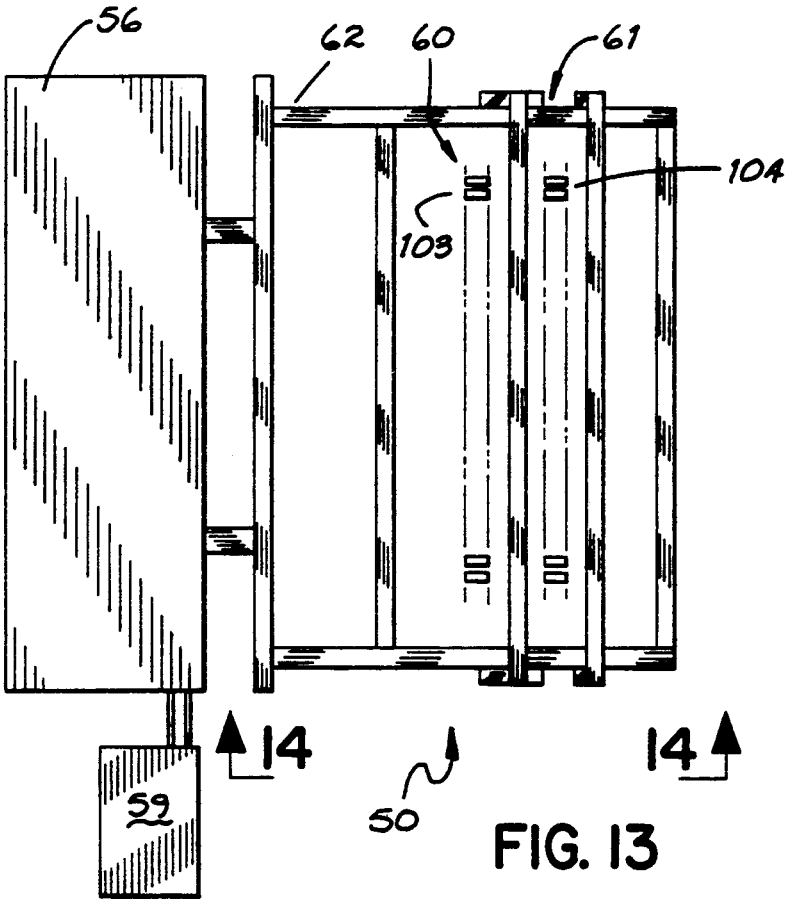
FIG. 13 is a plan view of the assembling apparatus of the system of FIG. 8.
Figure 14:
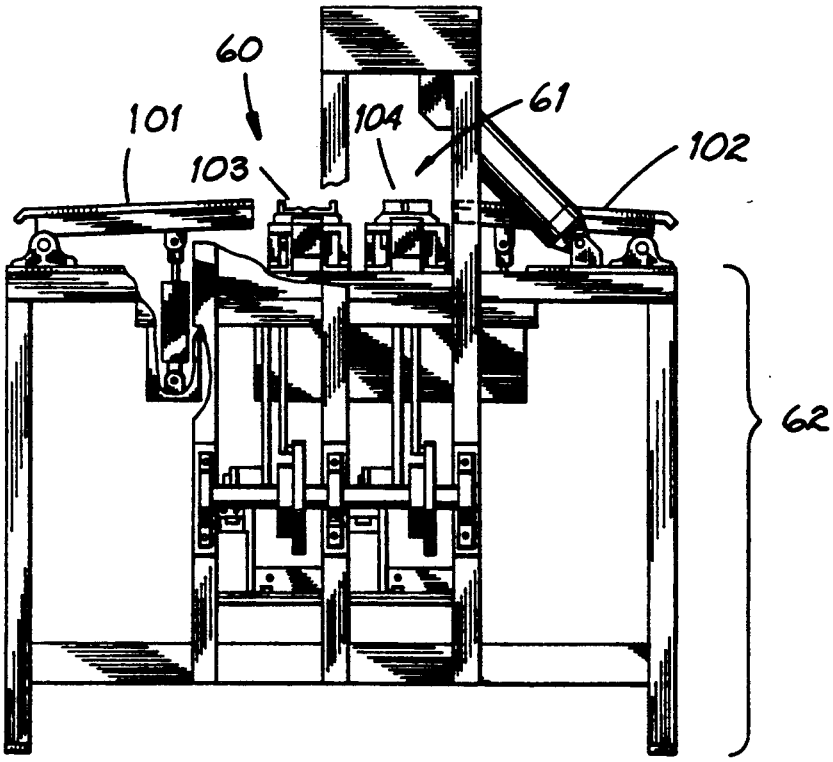
FIG. 14 is a side elevational view as seen on line 14—14 of FIG. 15 further illustrating the assembling apparatus of the system of FIG. 8.

Referring to FIG. 13, the spring interior assembly apparatus 50 includes a frame 62 to which is fixed the lacing station 56, the support structure reforming station 60 and the cut-off station 61. As further shown in FIG. 14, mounted at the top of the frame 62 and extending the length thereof are a pair of vertically pivotable tables 101 and 102 (not shown in FIG. 13 for clarity of the drawing) which raise the bands being advanced thereover to allow them to bypass a transversely spaced set of a plurality of forming dies 103 at the reforming station 60 and a corresponding transversely spaced set of a plurality of cut-off dies 104 at the cut-off station 61. When, as illustrated in FIGS. 9F–9H, a transverse row of bridging portions is to be either reformed or cut, the tables 101 and 102 pivot to a lower position lowering the bands to bring the bridging portions 37 into position with respect to the dies 103 or 104.

Figure 15:
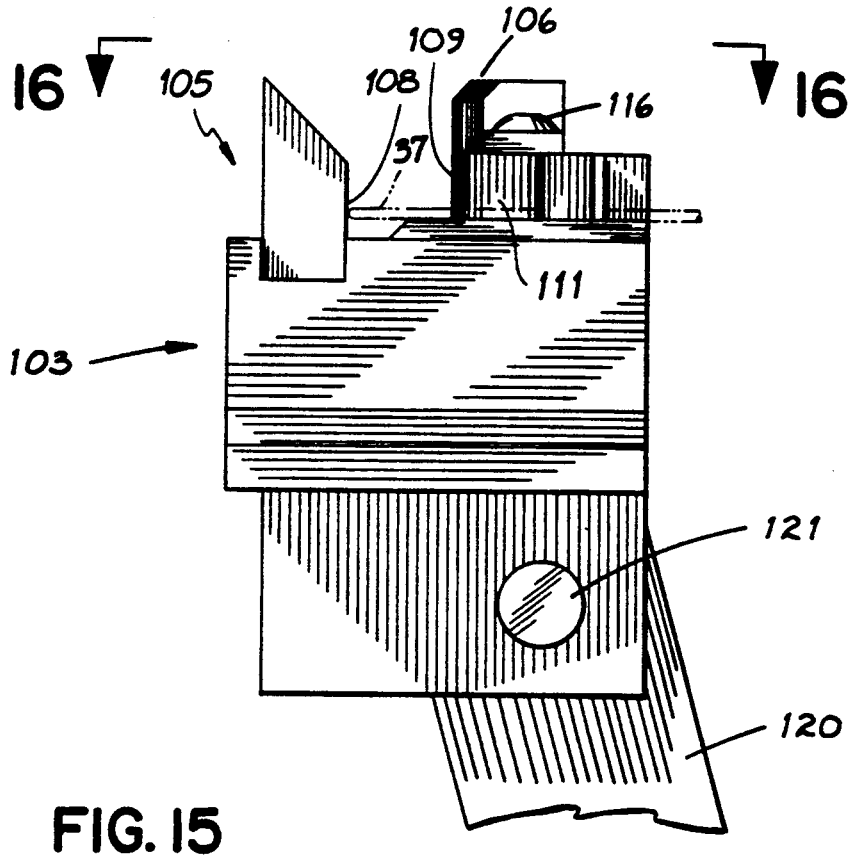
FIG. 15 is a side elevational view of one of the reforming dies of the reforming station of the apparatus of FIG. 13.
Figure 16:
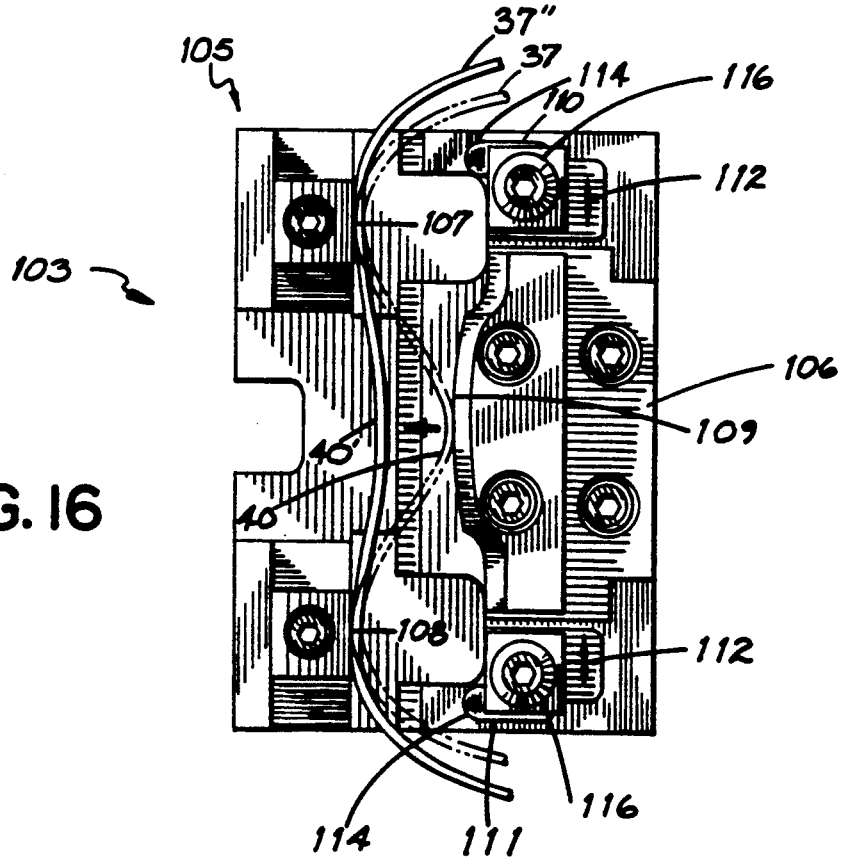
FIG. 16 is a top elevational view as seen on line 16—16 of FIG. 15.

Referring to FIGS. 15 and 16, the reforming dies 103 are illustrated. These dies include a stationary die assembly 105 and a movable die assembly 106. When the tables 101 and 102 are lowered, a bridging portion 37 with the nose 40 is dropped between a pair of forming surfaces 107 and 108 of the stationary die 105 and a forming surface 109 of the movable die 106. The movable die 106 moves toward and away from the fixed die 105. When moving toward the fixed die 105, the center forming surface 109 contacts the tip of the nose 40 of the bridging portion 37 to flatten it to form a flattened nose portion 40'. This procedure lengthens the bridging portion 37 to the shape of the bridging portion 37''. This lengthening is adjustable by a pair of adjustable fingers 110 and 111 on the movable die 106 which are adjustable longitudinally along the path of the bands as shown by the arrows 112. The fingers 110 have an additional forming surface 114 which contact the wire of the bridging portions 37 as the dies are closed to determine the amount of lengthening of the bridging portion 37'' to be imparted. The fingers 110 and 111 are, accordingly, adjustably mounted with bolts 116 to the assembly 106 in the manner similar to those formers of the nose forming dies illustrated in FIGS. 10–12. The movable die 106 is moved by a lever 120 activated by any known means (not shown) which is connected to a fixed pivot pin 121 carried by the fixed die 105.

Figure 17:
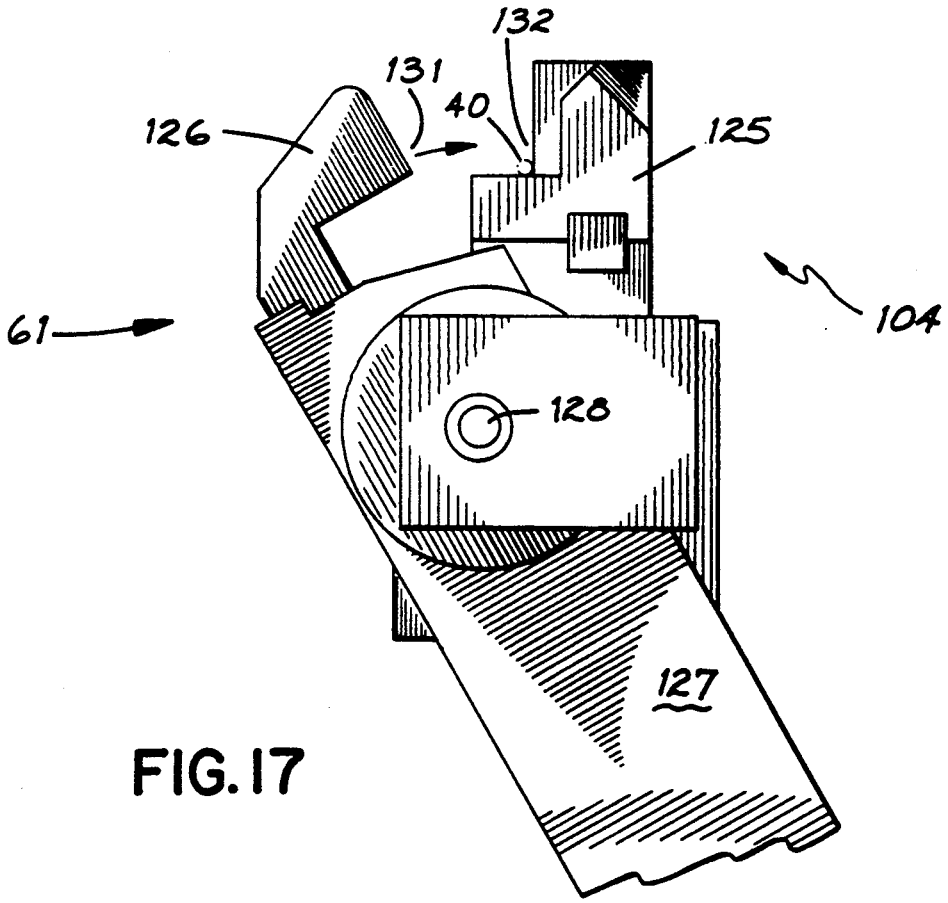
FIG. 17 is a side view of one of the cutting dies of the cutting station of the apparatus illustrated in FIG. 13.

Referring to FIG. 17, the cutting station 61 includes sets of the cut-off dies 104. The cut-off dies 104 include a fixed cut-off die 125 and a movable cut-off die 126. The movable dies 126 are each carried by a cut-off lever 127 which is pivotally connected at pivot pin 128 to the assembly of the fixed die 125, the lever being activated by any known means (not shown). A pair of die cutting surfaces 131 and 132 are carried by the fixed and movable cut-off dies 125 and 126, respectively to cut the center 42 of bridging portion's nose 40.

While only a single preferred embodiment of the invention is described, persons skilled in the art to which it pertains will appreciate changes and modifications which may be made without departing from the spirit of the invention. Therefore it is intended that this patent be limited only by the scope of the following claims.

I claim:

1. A spring interior forming and assembling apparatus comprising:

a frame;

means for supplying a plurality of continuous spring bands, each having formed therealong a plurality of spring coils of alternate rotation and being joined to the adjacent coils by bridging segments integral with the coil springs;

a segment forming station mounted adjacent the band supplying means, the forming station including a plurality of means for forming segments of the bands into bends, the forming means including adjustable means for adjustably determining the shape of the formed bends so as to control the spacing between adjacent coils;

means for feeding the plurality of bands formed at the segment forming station along a plurality of parallel paths extending longitudinally across the frame;

a segment reforming station mounted on the frame, extending transverse the paths, the reforming station having a plurality of means, one adjacent each of the paths, for reshaping selected ones of the formed bends of each of the bands to alter the spacing between adjacent coils a selected pair; and a segment cutting station mounted on the frame, spaced from the segment reforming station and extending transverse the paths and spaced from the forming station, the cutting station having a plurality of means, one adjacent each of the paths, for cutting selected segments of the bands.

2. The apparatus of claim 1 further comprising:
means adjacent the paths for repeatedly cutting and feeding lengths of lacing coil transversly of the paths, by spirally advancing the each coil in the direction of the wire of which it is formed, transversly across the paths to transversly join the adjacent coils of each row; and
means for simultaneously advancing the bands along the paths a distance equal to the spacing between adjacent rows of coils after each operation of the cutting and feeding means.

3. The apparatus of claim 1 further comprising:
means at the forming station for forming the pair of coils adjacent to and opposite each of the bridging sections to different radii.

4. The apparatus of claim 1 wherein:
the reforming means includes adjustable means for adjustably determining the shape of the formed bends so as to control the spacing between the coils adjacent thereto.

5. The apparatus of claim 1 wherein:
the forming means includes adjustable means for adjustably determining the shape of the formed bends so as to control the spacing between adjacent coils.

6. The apparatus of claim 5 wherein:
the reforming means includes adjustable means for adjustably determining the shape of the formed bends so as to control the spacing between coils adjacent to the bridging section containing the bend reformed thereby.

7. The apparatus of claim 13 wherein:
the reforming means includes adjustable means for adjustably determining the shape of the formed bends so as to control the spacing between coils adjacent to the bridging section containing the bend reformed thereby.

8. A spring interior forming and assembling apparatus comprising:
a frame;
means for supplying a plurality of continuous spring bands, each having formed therealong a plurality of spring coils of alternate rotation and being joined to the adjacent coil springs by bridging segments integral with the coils springs;
means for feeding the plurality of bands along a plurality of parallel paths extending longitudinally across the frame;
a segment forming station mounted on the frame and extending transverse the paths, the forming station having a plurality of means, one adjacent each of the paths, for forming the segments of each of the bands into bends;
a segment cutting station mounted on the frame, extending transverse the paths and spaced from the forming station, the cutting station having a plurality of means, one adjacent each of the paths, for cutting each of the bands across a transverse row of selected segments of the bands into lengths of equal numbers of coils and bridging segments; and
the forming means including means for adjusting the cut lengths of the bands including adjustable forming dies for adjustable determining the shape of the formed bends so as to control the spacing between adjacent coils of a band.

9. The apparatus of claim 8 further comprising:
means adjacent the paths for repeatedly cutting and feeding lengths of lacing coil transversly of the paths, by spirally advancing the each coil in the direction of the wire of which it is formed, transversly across the paths to transversly join the adjacent coils of each row; and
means for simultaneously advancing the bands along the paths a distance equal to the spacing between adjacent rows of coils after each operation of the cutting and feeding means.

10. The apparatus of claim 8 further comprising:
means at the forming station for forming the pair of coils adjacent to and opposite each of the bridging sections to different radii.

11. The apparatus of claim 8 wherein the segment forming means at the forming station includes independently adjustable dies each operative to differently shape selected ones of the formed bends of each of the bands to independently alter a spacing between adjacent coils a selected pair of coils of each of the bands to thereby adjust the relative cut lengths of the bands.

12. The apparatus of claim 8 wherein:
the forming means includes a plurality of adjustable dies, one adjacent each of the paths, for differently shaping selected ones of the formed bends of each of the bands to alter the spacing between adjacent coils a selected pair and thereby adjusting the cut lengths of the bands with respect to each other.

13. A spring interior forming and assembling apparatus comprising:
means for supplying a plurality of continuous spring bands, each having formed therealong a plurality of spring coils of alternate rotation and being joined to the adjacent coils by bridging segments integral with the coil springs, the bridging segments of the bands having bends formed therein, the shapes of which control the spacing between adjacent coils of the bands;
means for feeding the plurality of bands having the segments thereof formed at the segment forming stations longitudinally along a plurality of parallel paths;
a segment reforming station extending transverse the paths and having a plurality of means, one adjacent each of the paths, for reshaping selected ones of the formed bends of each of the bands to alter the spacing between adjacent coils of a selected pair of coils to thereby alter the lengths of the bridging segments reformed thereby, the reforming station having means selectively operating the reshaping means to change the shape of the formed bends of some, but not all, of the bridging segments; and
a segment cutting station extending transverse the paths and having a plurality of means, one adjacent each of the paths, for cutting selected segments of the bands.

14. The apparatus of claim 13 further comprising:
means adjacent the paths for repeatedly cutting and feeding lengths of lacing coil transversly of the paths, by spirally advancing the each coil in the direction of the wire of which it is formed, transversly across the paths to transversly join the adjacent coils of each row; and
means for simultaneously advancing the bands along the paths a distance equal to the spacing between adjacent rows of coils after each operation of the cutting and feeding means.

15. The apparatus of claim 13 further comprising:

means at the forming station for forming the pair of coils adjacent to and opposite each of the bridging sections to different radii.

16. The apparatus of claim 13 wherein:

the reforming means includes adjustable means for adjustably determining the shape of the formed bends so as to control the spacing between the coils adjacent thereto.

17. A method of forming and assembling a spring interior forming comprising the steps of:

supplying a plurality of continuous spring bands, each having formed therealong a plurality of spring coils of alternate rotation and being joined to the adjacent coils by bridging segments integral with the coil springs, each of the bridging segments being formed into bends, the shape of which determines the spacing between adjacent coils of the bands;

feeding the plurality of bands along a plurality of parallel paths extending longitudinally across a frame;

selecting one of the bridging sections of each of the bands lying in a row across the paths transverse to the frame, and changing the shapes of the bends previously formed in each of the selected bridging sections to alter the spacing between coils adjacent thereto; and cutting each of the bands at one of the bridging sections spaced rom the selected sections of the bands.

18. The method of claim 17 wherein:

the cutting step includes the step of forming wire ends of each of the bands at the cut bridging sections shortening the length of the cut bridging sections thereby; and the reforming step includes the step of flattening the previously formed bends of the selected bridging sections to increase the spacing between the coils adjacent thereto so as to compensate for the shortening caused by the cutting step.

19. The method of claim 17 further comprising the steps of:

forming the plurality of continuous spring bands by forming in each a plurality of spring coils of alternate rotation and being joined to the adjacent coils by bridging segments integral with the coil springs, thereafter forming in each of the bridging segments bends, the shape of which determine the spacing between adjacent coils of the bands, and then winding each of the bands into one of a plurality of rolls; and wherein the feeding step includes the step of feeding each of the bands from the rolls along each of the paths.

* * * * *

UNITED STATES PATENT AND TRADEMARK OFFICE

CERTIFICATE OF CORRECTION

PATENT NO. : 5,139,054

DATED : August 18, 1992

INVENTOR(S) : Long et al.

It is certified that error appears in the above-identified patent and that said Letters Patent is hereby corrected as shown below:

Col. 13, line 47, "structure 40, as" should be --structure 40' as--

Col. 17, line 32, "claim 13" should be --claim 1--

Col. 17, line 44, "adjacent coil springs by" should be --adjacent coils by--

Col. 17, line 63, "adjustable determining" should be --adjustably determining--

Col. 18, line 17, "alter a spacing" should be --alter the spacing--

Col. 18, line 26, "thereby adjusting the cut lengths" should be --thereby adjust the cut lengths--

Col. 20, line 2, "spaced rom" should be --spaced from

Signed and Sealed this

First Day of February, 1994

Bruce Lehman

*Attest:*

BRUCE LEHMAN

*Attesting Officer*

*Commissioner of Patents and Trademarks*